US008329373B2

(12) United States Patent
Norikane et al.

(10) Patent No.: US 8,329,373 B2
(45) Date of Patent: Dec. 11, 2012

(54) METHOD AND APPARATUS FOR PRODUCING TONER

(75) Inventors: Yoshihiro Norikane, Yokohama (JP); Shinji Aoki, Yokohama (JP); Masaru Ohgaki, Yokohama (JP); Yohichiroh Watanabe, Fuji (JP); Takahiro Honda, Fujinomiya (JP); Andrew Mwaniki Mulwa, Atsugi (JP); Yuko Sekiguchi, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 495 days.

(21) Appl. No.: 12/589,555

(22) Filed: Oct. 23, 2009

(65) Prior Publication Data

US 2010/0104970 A1 Apr. 29, 2010

(30) Foreign Application Priority Data

Oct. 24, 2008 (JP) ..... 2008-274642

(51) Int. Cl.
*G03G 5/00* (2006.01)

(52) U.S. Cl. ..... 430/137.1; 430/108.1

(58) Field of Classification Search ..... 430/108.1, 430/110.4, 137.1, 137.14
See application file for complete search history.

(56) References Cited

U.S. PATENT DOCUMENTS

| | | | | |
|---|---|---|---|---|
| 6,852,463 | B2 | 2/2005 | Teshima | |
| 2006/0210909 | A1 | 9/2006 | Ohtani | |
| 2008/0063971 | A1 * | 3/2008 | Watanabe et al. | 430/110.4 |
| 2008/0227011 | A1 | 9/2008 | Kuramoto et al. | |
| 2008/0241727 | A1 | 10/2008 | Norikane et al. | |
| 2008/0248416 | A1 | 10/2008 | Norikane et al. | |
| 2008/0286679 | A1 | 11/2008 | Norikane et al. | |
| 2008/0286680 | A1 | 11/2008 | Norikane et al. | |
| 2008/0292985 | A1 | 11/2008 | Suzuki et al. | |
| 2009/0117486 | A1 | 5/2009 | Watanabe et al. | |
| 2009/0170018 | A1 | 7/2009 | Kuramoto et al. | |
| 2010/0003613 | A1 * | 1/2010 | Honda et al. | 430/110.4 |

FOREIGN PATENT DOCUMENTS

| | | |
|---|---|---|
| JP | 2003-262976 | 9/2003 |
| JP | 2003-262977 | 9/2003 |
| JP | 2006-293320 | 10/2006 |

* cited by examiner

*Primary Examiner* — Stewart Fraser
(74) *Attorney, Agent, or Firm* — Cooper & Dunham LLP

(57) ABSTRACT

A method and an apparatus for producing toner are provided. A fluid comprising a resin and a colorant is supplied to a retention member that includes a film on which multiple discharge openings are formed. The fluid which is supplied to the retention member is resonated so that liquid droplets thereof are discharged from the multiple openings. The liquid droplets which are discharged from the multiple openings are solidified to form mother particles of a toner.

10 Claims, 6 Drawing Sheets

METHOD AND APPARATUS FOR PRODUCING TONER

BACKGROUND OF THE INVENTION

1. Field of the Invention

The present invention relates to a method and an apparatus for producing toner.

2. Discussion of the Related Art

In image forming processes such as electrophotography, electrostatic recording, and electrostatic printing, electrostatic latent images are generally developed with developers. More specifically, a developer is adhered to an electrostatic latent image that is formed on an electrostatic latent image bearing member. Subsequently, the developer is transferred from the electrostatic latent image bearing member onto a transfer medium and fixed thereon. Developers are broadly classified into two-component developers comprising a carrier and a toner and one-component developers comprising no carrier and a toner (e.g., a magnetic toner, a non-magnetic toner).

Toners may be produced by what is called pulverization methods. However, pulverization methods have a disadvantage that the resulting toner particles have a wide variety of shape and size.

Recently, polymerization methods such as suspension polymerization methods, emulsion polymerization aggregation methods, dissolution suspension methods, and ester elongation polymerization methods have been proposed as methods for producing toner. Polymerization methods generally use dispersing agents in aqueous media. If dispersing agents remain on the surface of the resultant toner, chargeability and environmental stability of the toner may deteriorate. In order to remove remaining dispersing agents, disadvantageously, an extremely large amount of washing water is needed.

Additionally, spray drying methods have been also proposed as methods for producing toner recently. Spray drying methods also have a disadvantage that the resulting toner particles have a wide variety of shape and size.

Japanese Patent No. 3786034 discloses a toner production apparatus including a head part and a solidifying part. The head part discharges a raw material which has fluidity. The solidifying part solidifies the granular raw material discharged from the head part. The head part includes a raw material storage part, a piezoelectric substance that applies piezoelectric pulses to the raw material stored in the raw material storage part, and a discharge part that discharges the raw material by the piezoelectric pulses. The raw material storage part includes a vibration plate that is vibrated by vibration of the piezoelectric substance. Upon deformation of the piezoelectric substance, the vibration plate bends, thereby reducing the volume of the raw material storage part. As a result, the pressure in the raw material storage part instantaneously increases and granular raw material is discharged from the discharge part. This toner production apparatus has a disadvantage that the resultant particles have a wide size distribution, which may result in poor toner productivity. This is because only one piezoelectric substance is provided as against multiple discharge parts.

SUMMARY OF THE INVENTION

Accordingly, exemplary embodiments of the present invention provide a method and an apparatus for producing toner which can produce a toner having a narrow size distribution with high productivity.

These and other features and advantages of the present invention, either individually or in combinations thereof, as hereinafter will become more readily apparent can be attained by exemplary embodiments described below.

One exemplary embodiment provides a method for producing toner including supplying a fluid comprising a resin and a colorant to a retention member that includes a film on which multiple discharge openings are formed; discharging liquid droplets of the fluid which is supplied to the retention member from the multiple discharge openings by resonating the fluid; and solidifying the liquid droplets which are discharged from the multiple discharge openings to form mother particles of a toner.

Another exemplary embodiment provides an apparatus for producing toner including a discharge device and a solidifying device. The discharge device includes a retention member and a vibration application member. The retention member is configured to retain a fluid comprising a resin and a colorant, and includes a film on which multiple discharge openings are formed. The vibration application member is configured to resonate the fluid which is supplied to the retention member to discharge liquid droplets of the fluid from the multiple discharge openings. The solidifying device is configured to solidify the liquid droplets which are discharged from the multiple discharge openings to form mother particles of a toner.

BRIEF DESCRIPTION OF THE DRAWINGS

A more complete appreciation of the embodiments described herein and many of the attendant advantages thereof will be readily obtained as the same becomes better understood by reference to the following detailed description when considered in connection with the accompanying drawings, wherein.

DESCRIPTION OF THE PREFERRED EMBODIMENTS

Preferred embodiments of the present invention are described below with reference to the accompanying drawings.

Figure 1:
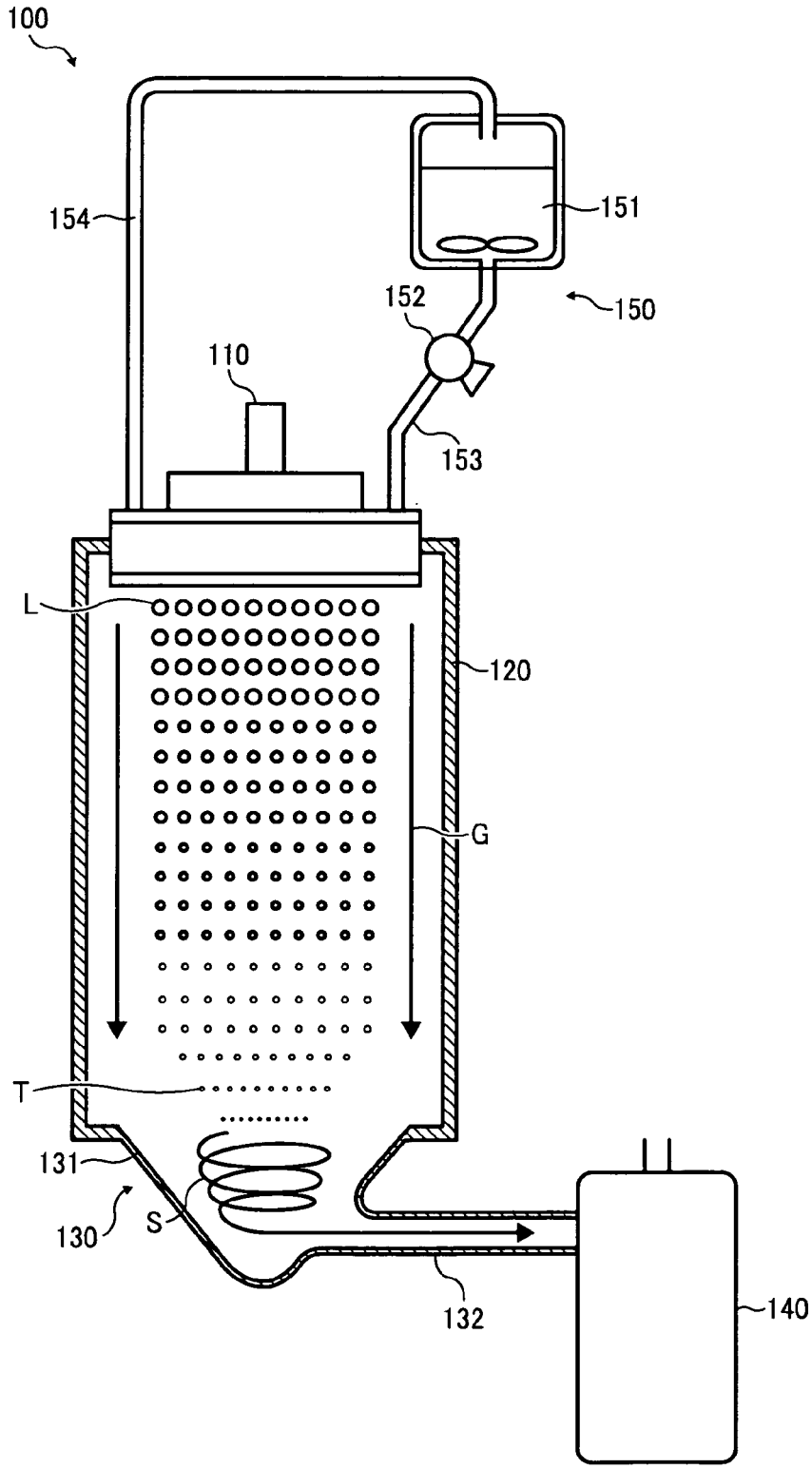
FIG. 1 is a schematic view illustrating an exemplary embodiment of a toner production apparatus.

FIG. 1 is a schematic view illustrating an exemplary embodiment of a toner production apparatus. A toner production apparatus 100 includes a liquid droplet discharge unit 110, a drying tower 120, a collection part 130, a storage part 140, and a supply part 150. The liquid droplet discharge unit 110 is configured to discharge a toner components liquid in which toner components such as a resin and a colorant are dissolved or dispersed in a solvent, to form liquid droplets L thereof. The drying tower 120 is provided below the liquid droplet discharge unit 110, and is configured to form mother particles T by drying the liquid droplets L with a dry gas G. The collection part 130 is configured to collect the mother particles T. The storage part 140 is configured to store the mother particles T collected by the collection part 130. The supply part 150 is configured to supply the toner components liquid to the liquid droplet discharge unit 110.

The supply part 150 includes a tank 151, a pump 152, a supply pipe 153, and a discharge pipe 154. The tank 151 is configured to store the toner components liquid. The pump 152 is configured to feed the toner components liquid by pressure. The supply pipe 153 is configured to supply the toner components liquid to the liquid droplet discharge unit 110. The discharge pipe 154 is configured to discharge the toner components liquid from the liquid droplet discharge unit 110. The tank 151, the pump 152, the supply pipe 153, and the discharge pipe 154 constitute a circulation system. When the liquid droplet discharge unit 110 discharges liquid droplets L, the toner components liquid is self-supplied from the tank 151 to the liquid droplet discharge unit 110. When the toner production apparatus 100 is in operation, the toner components liquid is supplementarily supplied to the liquid droplet discharge unit 110 by the pump 152. Bubbles in the toner components liquid are discharged through the discharge pipe 154.

Figure 2A:
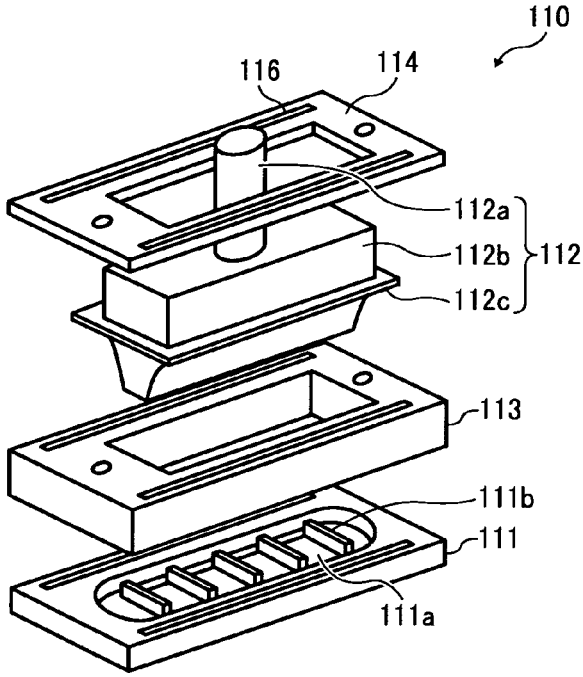
FIGS. 2A and 2B are schematic exploded and cross-sectional views, respectively, illustrating an exemplary embodiment of a liquid droplet discharge unit.
Figure 2B:
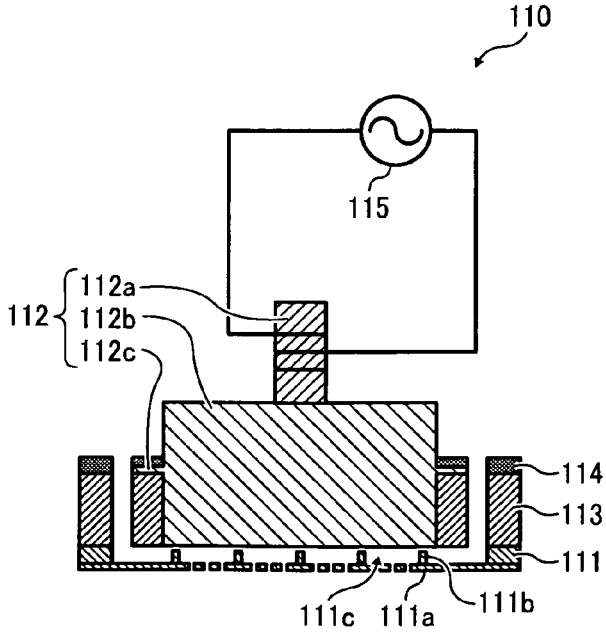

FIGS. 2A and 2B are schematic exploded and cross-sectional views, respectively, illustrating an exemplary embodiment of the liquid droplet discharge unit 110. The liquid droplet discharge unit 110 includes a thin film 111*a*, a retention member 111, and a vibration application member 112. The thin film 111*a* is made of a complex of silicon and silicon oxide, and multiple discharge openings are formed thereon. The retention member 111 is configured to retain the toner components liquid. The vibration application member 112 is configured to apply an ultrasonic vibration having a frequency less than the resonance frequency of the thin film 111*a* to the toner components liquid which is supplied to the retention member 111, so that the toner components liquid which is supplied to the retention member 111 is resonated. As a result, liquid droplets L are discharged from the multiple discharge openings.

The resonance frequency of the thin film 111*a* may be measured with a laser Doppler vibration measuring method.

The thin film 111*a* is bonded to the retention member 111 with a resin which has resistance to solvents used for the toner components liquid. Multiple retention regions 111*c* are formed by multiple partitions 111*b* within the retention member 111. The toner components liquid is supplied to and discharged from the multiple retention regions 111*c* through the supply pipe 153 and the discharge pipe 154, respectively. The thin film 111*a* maybe formed by a silicon process, which forms discharge openings having high shape accuracy and a large aspect ratio. In the present embodiment, the thin film 111*a* has a thickness of from 10 to 500 μm and the discharge opening has an aperture diameter of from 4 to 15 μm. With such a configuration, liquid droplets L are discharged from the discharge openings uniformly. When the thickness is too small, stiffness of the thin film 111*a* may be small, which results in a small resonance frequency. When the thickness is too large, it may be difficult to discharge liquid droplets. When the aperture diameter is too small, colorants in the toner components liquid may deposit on the discharge openings, thereby suppressing reliable discharge of liquid droplets. When the aperture diameter is too large, it may be difficult to discharge liquid droplets uniformly.

FIGS. 3A to 3D are schematic views illustrating an exemplary method of forming the thin film 111*a*.

Figure 3A:
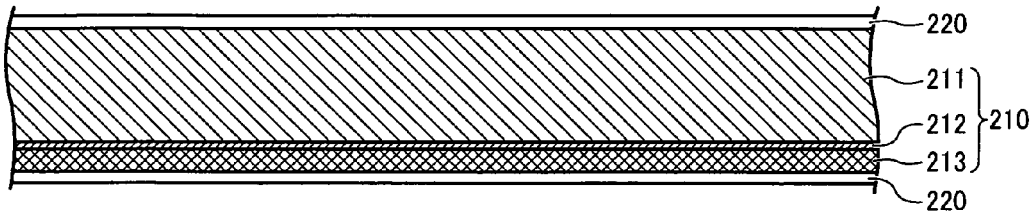
FIGS. 3A to 3D are schematic views illustrating an exemplary method of forming a thin film.

First, as illustrated in FIG. 3A, both sides of an SOI (i.e., silicon on insulator) substrate 210 are coated with resists 220. The SOI substrate 210 is a multilayer which includes, in order from the top, a support layer 211, a dielectric layer 212, and an active layer 213.

Figure 3B:
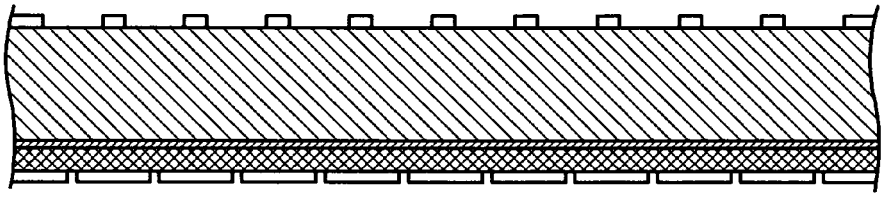

Next, as illustrated in FIG. 3B, the SOI substrate 210 is covered with photomasks including patterns of discharge openings and is exposed to ultraviolet ray to form patterns of discharge openings thereon.

Figure 3C:
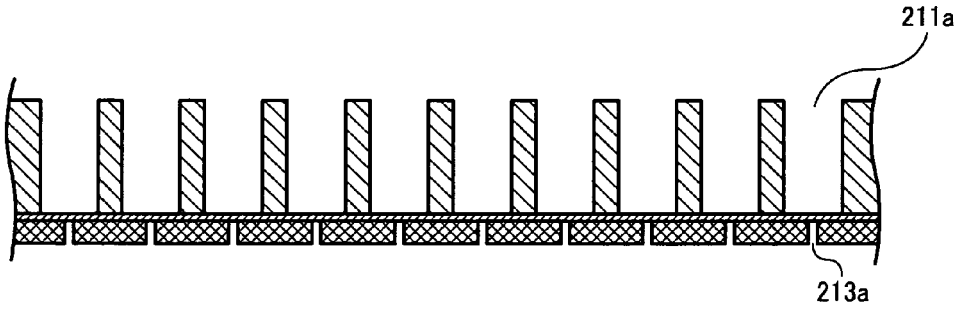

Next, as illustrated in FIG. 3C, a support layer 211 side of the SOI substrate 210 is subjected to dry etching using ICP electrical discharge so that openings 211*a* are formed. Subsequently, an active layer 213 side of the SOI substrate 210 is subjected to dry etching in the same manner so that openings 213*a* are formed.

Figure 3D:
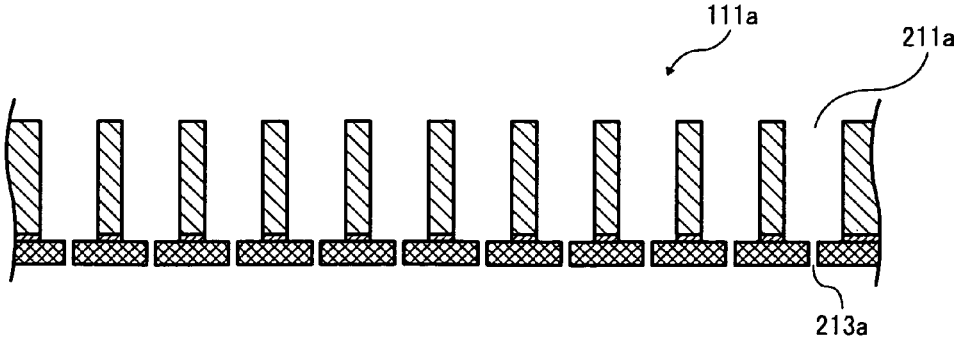

Finally, as illustrated in FIG. 3D, the dielectric layer 212 is removed by a hydrofluoric etching liquid to uniformly form two-step discharge openings.

The resulting thin film 111*a*, which is a complex of silicon and silicon oxide, has a large stiffness, which results in a large resonance frequency.

The SOI substrate may be replaced with a silicon substrate to form a thin film made of silicon on which multiple discharge openings are formed. In this case, the depth of the openings may be controlled by controlling the etching time. Such a thin film made of silicon has a large stiffness as well, which results in a large resonance frequency.

In order to increase the stiffness of the thin film, it is preferable to increase the thickness and decrease the surface area.

The partitions 111*b* are bonded to the thin film 111*a* with a resin which has resistance to solvents used for the toner components liquid. The partitions 111*b* may be made of materials having resistance to solvents used for the toner components liquid, such as metals, ceramics, and plastics, for example.

The number of discharge openings formed on each of the retention regions 111*c* is from 100 to 10,000. When the number of discharge openings is too small, toner productivity may decrease. When the number of discharge openings is too large, it may be difficult to discharge liquid droplets uniformly.

A support member, not shown, is attached to the retention member 111. The liquid droplet discharge unit 110 is provided on a top surface of the drying tower 120 by the support member. Alternatively, the liquid droplet discharge unit 110 may be provided on a side surface or a bottom surface of the drying tower 120.

The vibration application member 112 includes an ultrasonic vibrator 112*a* and an ultrasonic horn 112*b*. The ultrasonic horn 112*b* is configured to amplify ultrasonic vibration generated by the ultrasonic vibrator 112*a*. Upon application of a driving voltage (driving signal) having a predetermined frequency from a driving circuit (driving signal generating source) 115 to electrodes of the ultrasonic vibrator 112*a*, an ultrasonic vibration having a frequency of 20 kHz or more and less than 200 kHz is generated. The generated ultrasonic vibration is amplified by. the ultrasonic horn 112*b*, thereby periodically vibrating a vibration surface that is substantially parallel to the thin film 111*a*. As a result, a periodical pressure vibration is applied to the toner components liquid which is supplied to the retention member 111 and the toner components liquid is resonated. When the frequency is less than 20 kHz, colorants in the toner components liquid may deposit on the thin film 111*a*, thereby suppressing reliable discharge of liquid droplets. When the frequency is 200 kHz or more, it may be difficult to discharge liquid droplets uniformly.

Figure 4:
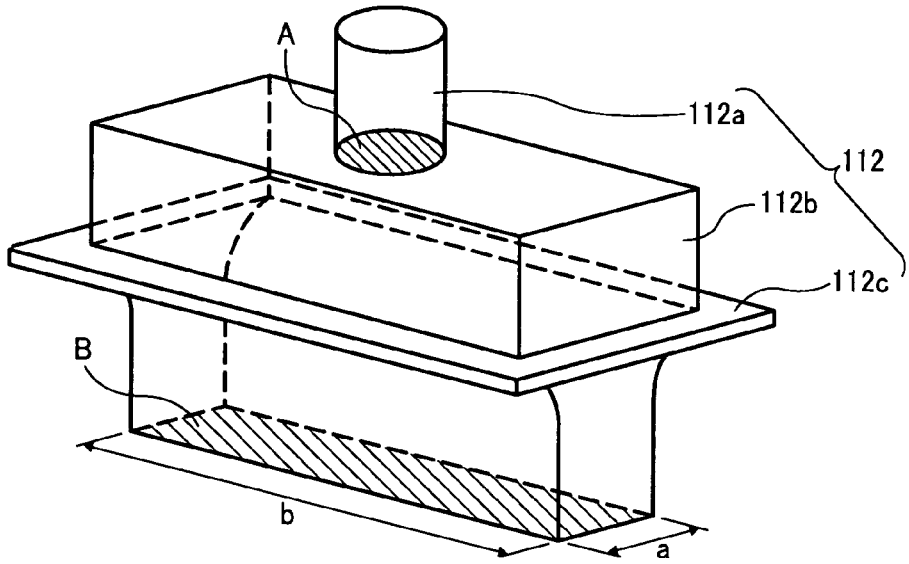
FIG. 4 is a schematic perspective view illustrating an exemplary embodiment of a vibration application member.

FIG. 4 is a schematic perspective view illustrating an exemplary embodiment of the vibration application member 112. As illustrated in FIG. 4, a bonded surface A between the ultrasonic vibrator 112*a* and the ultrasonic horn 112*b* has a smaller area than a vibration surface B of the ultrasonic horn 112*b*. The vibration surface B has a rectangular shape. Preferably, the ratio of the long side b to the short side a is 2 or more. When the ratio is less than 2, toner productivity may decrease due to such a small vibration area.

It is preferable that the ultrasonic vibrator 112*a* is a piezoelectric substance which can excite a large-area vibration surface with a low voltage. Piezoelectric substances generally have a function of converting electric energy to mechanical energy.

The piezoelectric substance may be a piezoelectric ceramic such as lead zirconate titanate (PZT), for example. Because of vibrating with a small displacement, such a substance is often laminated when used as the piezoelectric substance. Alternatively, the piezoelectric substance may be a piezoelectric polymer such as polyvinylidene fluoride (PVDF) or a single crystal of quartz, $LiNbO_3$, $LiTaO_3$, or $KNbO_3$, for example.

It is preferable that the ultrasonic vibrator 112*a* is a bolted Langevin vibrator. Since a piezoelectric substance is mechanically connected, the bolted Langevin vibrator has high strength and is unlikely to be damaged even when vibrating at a large amplitude.

In place of the ultrasonic vibrator 112*a*, a vertical vibrator capable of generating a vertical vibration having a frequency less than the resonance frequency of the thin film 111*a* may also be used.

The ultrasonic horn 112*b* amplifies vibration generated by the ultrasonic vibrator 112*a*. Therefore, the ultrasonic vibrator 112*a* need not generate a vibration with a large amplitude. As a result, mechanical load applied to the ultrasonic vibrator 112*a* is reduced and a lifespan of the vibration application member 112 is lengthened. The ultrasonic vibrator 112*a* is provided on a larger surface of the ultrasonic horn 112*b*. The vibration application member 112 is designed so that a smaller surface of the ultrasonic horn 112*b* vibrates at the maximum amplitude when the ultrasonic vibrator 112*a* generates a vibration having a predetermined frequency.

Figure 5A:
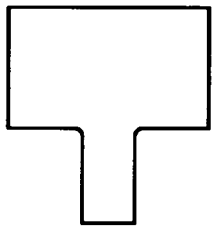
FIGS. 5A to 5C are schematic views illustrating exemplary embodiments of an ultrasonic vibrator.
Figure 5B:
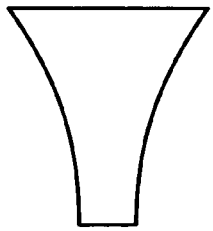
Figure 5C:
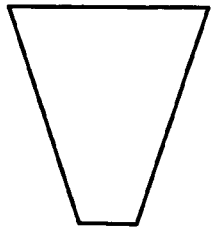

The ultrasonic vibrator 112*b* may have other shapes such as a step shape, an exponential shape, or a conical shape, as illustrated in FIGS. 5A, 5B, and 5C, respectively.

In a case in which the ultrasonic vibrator 112*a* generates a vibration with a large amplitude, the ultrasonic horn 112*b* need not necessarily be provided.

Referring back to FIGS. 2A and 2B, a vibration separation member 113 is provided between the retention member 111 and the vibration application member 112 so as not to transmit vibration to the retention member 111. The vibration application member 112 is fixed by sandwiching a node portion 112*c* thereof, which vibrates at a small vibration amplitude, between the vibration separation member 113 and a fixing member 114. The vibration separation member 113 may be an elastic body which has resistance to solvents used for the toner components liquid, such as a silicone adhesive (e.g., SIFEL from Shin-Etsu Silicones), for example. Alternatively, the vibration application member 112 may be fixed by sandwiching the node portion 112*c* between the retention member 111 and the fixing member 114 without providing the vibration separation member 113.

Figure 6:
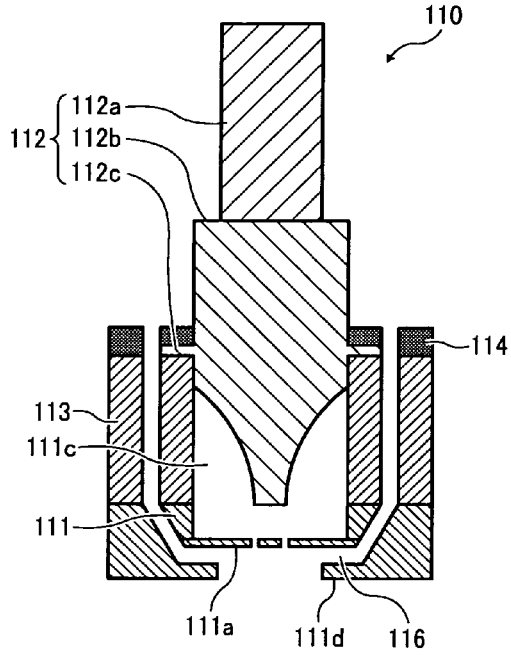
FIG. 6 is another schematic cross-sectional view of the liquid droplet discharge unit illustrated in FIG. 2.

FIG. 6 is another schematic cross-sectional view of the liquid droplet discharge unit 110. An airflow path 116 is configured to supply the dry gas G in a direction substantially the same as the direction of discharge of the liquid droplets L. The dry gas G accelerates drying of the liquid droplets L. Therefore, the liquid droplets L which are discharged from the multiple discharge openings are prevented from coalescence. On an immediately downstream side on the airflow path 116 from the discharge part of the liquid droplets L, a throttle 111*d* is provided. The throttle 111*d* is configured to reduce the cross-sectional area through which the dry gas G passes. The dry gas G may be air or nitrogen gas, for example.

Figure 7:
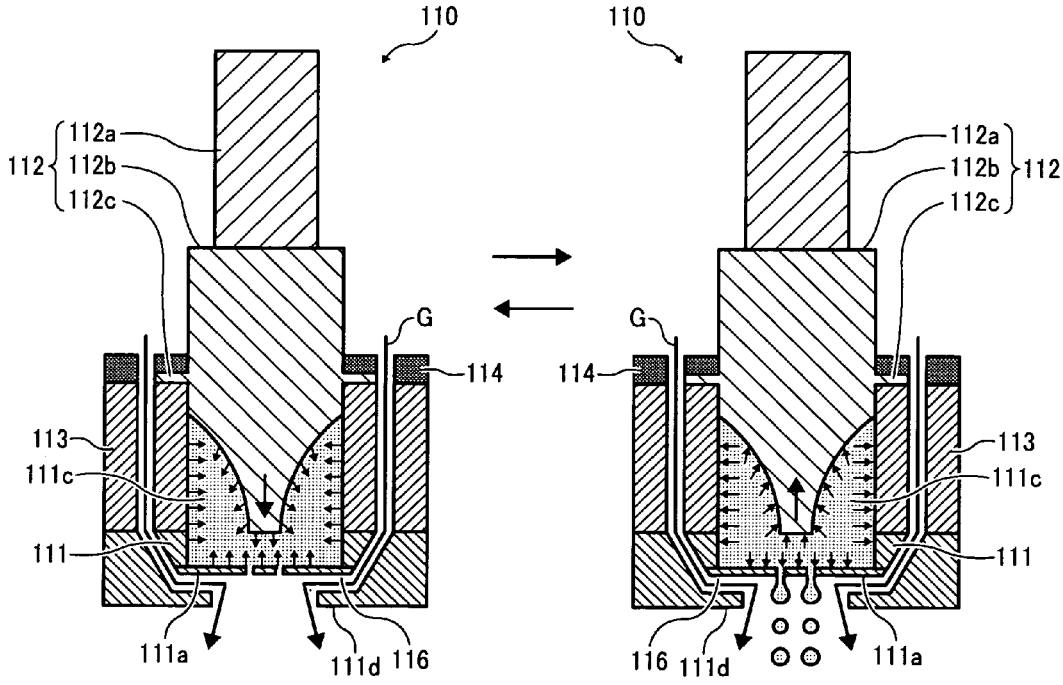
FIG. 7 is a schematic view illustrating a mechanism of forming liquid droplets in the liquid droplet discharge unit illustrated in FIG. 6.

FIG. 7 is a schematic view illustrating a mechanism of forming liquid droplets in the liquid droplet discharge unit 110. A vibration generated at the vibration surface of the vibration application member 112 is applied to the toner components liquid retained in the retention member 111. Thus, the toner components liquid resonates. In other words, the toner components liquid repeatedly expands and contracts. At the time the toner components liquid expands, liquid droplets L are discharged from the multiple discharge openings formed on the thin film 111*a*. The liquid droplets L are discharged from all of the multiple discharge openings evenly, thereby effectively forming mother particles T with a narrow size distribution.

Figure 8:
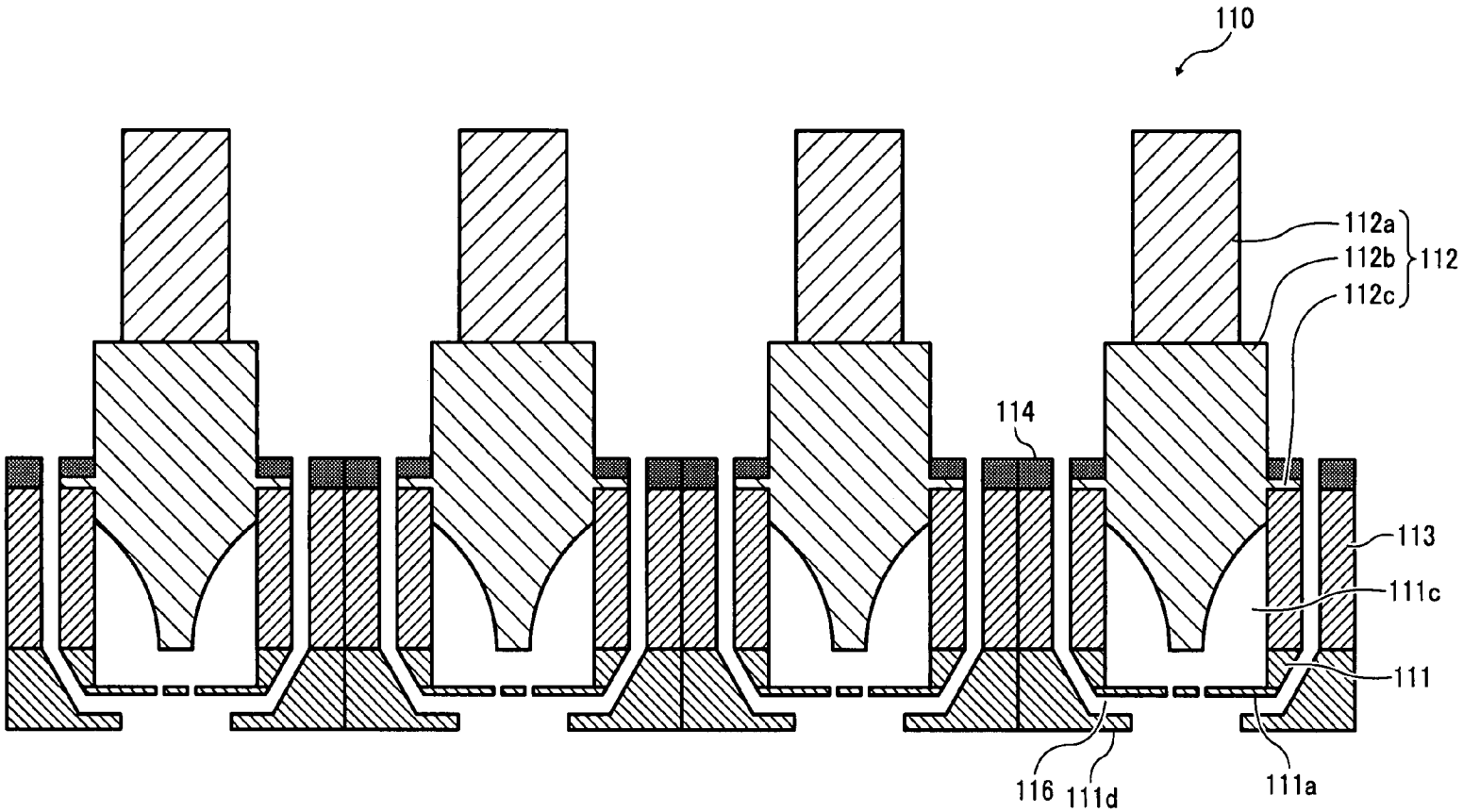
FIG. 8 is a schematic view illustrating an embodiment in which a plurality of liquid droplet discharge units is provided.

Referring to FIG. 1, a single liquid droplet discharge unit 110 is provided to the drying tower 120. For the purpose of increasing productivity, multiple liquid droplet discharge units 110 may be provided to the drying tower 120 as illustrated in FIG. 8. In this case, the number of the liquid droplet discharge units 110 provided to the drying tower 120 is preferably from 1,000 to 10,000. When the number of the liquid droplet discharge units 110 is too small, toner productivity may decrease. When the number of the liquid droplet discharge units 110 is too large, it may be difficult to control all the liquid droplet discharge units 110. The toner components liquid is supplied from the tank 151 through the supply pipe 153 to each retention region 111*c* of each liquid droplet discharge unit 110.

Referring back to FIG. 1, in the drying tower 120, the dry gas G flows in a direction substantially the same as the direction of discharge of the liquid droplets L from the liquid droplet discharge unit 110 so that the liquid droplets L are transported and dried by the dry gas G. Thus, mother particles T are formed.

The collection part 130 is connectively provided on a downstream side from the drying tower 120 relative to the direction of transportation of the mother particles T. The collection part 130 includes a tapered surface 131 that gradationally reduces the aperture diameter from the upstream side toward the downstream side. A suction pump, not shown, generates a vortex flow S that flows from the upstream side toward the downstream side within the collection part 131. The mother particles T are collected by the vortex flow S and stored in the storage part 140 through a pipe 132. At that time, the mother particles T may be fed from the collection part 130 to the storage part 140 by pressure, or sucked from the storage part 140.

An exemplary method of producing toner using the toner production apparatus 100 is described below. First, the toner components liquid is supplied to the retention member 111 of the liquid droplet discharge unit 110. A driving signal having a predetermined driving frequency is applied to the ultrasonic vibrator 112*a* of the vibration application member 112 so that the ultrasonic vibrator 112*a* generates a vibration. The vibration is amplified by the ultrasonic horn 112*b*, and the toner components liquid in the retention member 111 is resonated. Specifically, the vibration of the vibration surface of the vibration application member 112 is transmitted to the toner components liquid in the retention member 111, thereby generating a periodical pressure variation. When pressure is applied, liquid droplets L of the toner components liquid are periodically discharged from the multiple discharge openings into the drying tower 120.

The liquid droplets L are transported by the dry gas G, which flows in a direction substantially the same as the direction of discharge of the liquid droplets L, in the drying tower 120. As a result, solvents are removed from the liquid droplets L and mother particles T are formed. The mother particles T are collected by the vortex flow S in the collection part 130 provided on a downstream side from the drying tower 120, and are transported to and stored in the storage part 140. The ratio of the weight average particle diameter to the number average particle diameter of the mother particles T may be from 1.00 to 1.15. The weight average particle diameter of the mother particles T may be from 1 to 20 μm.

Because of including multiple discharge openings, the liquid droplet discharge unit 110 can continuously discharge multiple liquid droplets L, which results in drastic improvement of toner productivity. Because the toner components liquid in the retention member 111 resonates, a toner with a narrow size distribution can be provided. In addition, colorants in the toner components liquid are unlikely to deposit on the thin film 111*a*. Therefore, clogging of the discharge openings is prevented.

In the present embodiment, the toner components liquid in which toner components including a resin and a colorant are dissolved or dispersed in a solvent is formed into liquid droplets by the liquid droplet discharge unit 110, and subsequently the liquid droplets are dried in the drying tower 120 to form mother particles T. Alternatively, when the toner components liquid includes a hardening resin, liquid droplets L may be hardened in the drying tower 120. Alternatively, when the toner components liquid is formed by melting toner components, liquid droplets L may be cooled to form mother particles T.

Exemplary embodiments of the toner components liquid are described below. The toner components liquid is obtained by dissolving or dispersing toner components comprising a resin and a colorant, optionally including a wax and a magnetic material, in a solvent. The toner components may be mixed and kneaded in advance using a high-shear disperser such as a three-roll mill.

Specific examples of solvents which are capable of dissolving or dispersing toner components include, but are not limited to, ethyl acetate, toluene, and methyl ethyl ketone. These solvents can be used alone or in combination.

Specific preferred examples of usable resins include, but are not limited to, vinyl polymers such as styrene resins and styrene-(meth)acrylic resins, polyesters, polyol resins, phenol resins, silicone resins, polyurethanes, polyamides, furan resins, epoxy resins, xylene resins, terpene resins, coumarone-indene resins, polycarbonates, and petroleum resins. These resins can be used alone or in combination.

Specific examples of usable monomers for preparing vinyl polymers include, but are not limited to, styrene monomers (e.g., styrene, o-methylstyrene, m-methylstyrene, p-methylstyrene, p-phenylstyrene, p-ethylstyrene, 2,4-dimethylstyrene, p-n-amylstyrene, p-tert-butylstyrene, p-n-hexylstyrene, p-n-octylstyrene, p-n-nonylstyrene, p-n-decylstyrene, p-n-dodecylstyrene, p-methoxystyrene, p-chlorostyrene, 3,4-dichlorostyrene, m-nitrostyrene, o-nitrostyrene, p-nitrostyrene); acrylic monomers (e.g., acrylic acid, methyl acrylate, ethyl acrylate, propyl acrylate, n-butyl acrylate, isobutyl acrylate, n-octyl acrylate, n-dodecyl acrylate, 2-ethylhexyl acrylate, stearyl acrylate, 2-chloroethyl acrylate, phenyl acrylate); methacrylic monomers (e.g., methacrylic acid, methyl methacrylate, ethyl methacrylate, propyl methacrylate, n-butyl methacrylate, isobutyl methacrylate, n-octyl methacrylate, n-dodecyl methacrylate, 2-ethylhexyl methacrylate, stearyl methacrylate, phenyl methacrylate, dimethylaminoethyl methacrylate, diethylaminoethyl methacrylate); monoolefins (e.g., ethylene, propylene, butylene, isobutylene); polyenes (e.g., butadiene, isoprene); vinyl halides (e.g., vinyl chloride, vinylidene chloride, vinyl bromide, vinyl fluoride); vinyl esters (e.g., vinyl acetate, vinyl propionate, vinyl benzoate); vinyl ethers (e.g., vinyl methyl ether, vinyl ethyl ether, vinyl isobutyl ether); vinyl ketones (e.g., vinyl methyl ketone, vinyl hexyl ketone, methyl isopropenyl ketone); N-vinyl compounds (e.g., N-vinylpyrrole, N-vinylcarbazole, N-vinylindole, N-vinylpyrrolidone); vinylnaphthalenes; acrylic or methacrylic acid derivatives (e.g., acrylonitrile, methacrylonitrile, acrylamide); unsaturated dibasic acids (e.g., maleic acid, citraconic acid, itaconic acid, alkenylsuccinic acid, fumaric acid, mesaconic acid) and anhydrides thereof; monoesters of unsaturated dibasic acids (e.g., monomethyl maleate, monoethyl maleate, monobutyl maleate, monomethyl citraconate, monoethyl citraconate, monobutyl citraconate, monomethyl itaconate, monomethyl alkenylsuccinate, monomethyl fumarate, monomethyl mesaconate); diesters of unsaturated dibasic acids (e.g., dimethyl maleate, dimethyl fumarate); α,β-unsaturated acids (e.g., crotonic acid, cinnamic acid) and anhydrides thereof, or anhydrides of the α,β-unsaturated acids with lower fatty acids; alkenylmalonic acid, alkenyl glutaric acid, and alkenyl adipic acid, and anhydrides or monoesters thereof; hydroxyalkyl esters of methacrylic or acrylic acids (e.g., 2-hydroxyethyl acrylate, 2-hydroxyethyl methacrylate, 2-hydroxypropyl methacrylate); and monomers having hydroxy group (e.g., 4-(1-hydroxy-1-methylbutyl)styrene, 4-(1-hydroxy-1-methylhexyl)styrene). These monomers can be used alone or in combination.

Vinyl monomers maybe cross-linked by using a cross-linking agent having 2 or more vinyl groups.

Specific examples of usable bifunctional cross-linking agents include, but are not limited to, aromatic divinyl compounds (e.g., divinylbenzene, divinylnaphthalene); diacrylate and dimethacrylate compounds bound with an alkylene group (e.g., ethylene glycol diacrylate, ethylene glycol dimethacrylate, 1,3-butylene glycol diacrylate, 1,3-butylene glycol dimethacrylate, 1,4-butanediol diacrylate, 1,4-butanediol dimethacrylate, 1,5-pentanediol diacrylate, 1,5-pentanediol dimethacrylate, 1,6-hexanediol diacrylate, 1,6-hexanediol dimethacrylate, neopentyl glycol dimethacrylate, neopentyl glycol diacrylate); and diacrylate and dimethacrylate compounds bound with an alkylene group having an ether bond (e.g., diethylene glycol diacrylate, diethylene glycol dimethacrylate, triethylene glycol diacrylate, triethylene glycol dimethacrylate, tetraethylene glycol diacrylate, tetraethylene glycol dimethacrylate, polyethylene glycol (#400) diacrylate, polyethylene glycol (#400) dimethacrylate, polyethylene glycol (#600) diacrylate, polyethylene glycol (#600) dimethacrylate, dipropylene glycol diacrylate, dipropylene glycol dimethacrylate). These bifunctional cross-linking agents can be used alone or in combination. Additionally, diacrylate and dimethacrylate compounds bound with an arylene group or an arylene group having an ether bond, and polyester-based diacrylate compounds are also usable as the bifunctional cross-linking agents. Specific examples of commercially available polyester-based diacrylate compounds include, but are not limited to, MANDA (from Nippon Kayaku Co., Ltd.).

Specific examples of usable polyfunctional cross-linking agents include, but are not limited to, pentaerythritol triacrylate, pentaerythritol trimethacrylate, trimethylolethane triacrylate, trimethylolethane trimethacrylate, trimethylolpropane triacrylate, trimethylolpropane trimethacrylate, tetramethylolmethane tetraacrylate, tetramethylolmethane tetramethacrylate, oligo ester acrylate, oligo ester methacrylate, triacyl cyanurate, and triallyl trimellitate. These polyfunctional cross-linking agents can be used alone or in combination.

From the viewpoint of fixability and hot offset resistance of the resultant toner, aromatic divinyl compounds, preferably divinylbenzene, and diacrylate and dimethacrylate compounds bound with an arylene group or an arylene group having an ether group are preferable.

The usable amount of cross-linking agents is preferably from 0.01 to 10% by weight, and more preferably from 0.03 to 5% by weight, based on total weight of monomers.

Specific examples of usable polymerization initiators for preparing vinyl polymers include, but are not limited to, 2,2'-azobisisobutyronitrile, 2,2'-azobis(4-methoxy-2,4-dimethylvaleronitrile), 2,2'-azobis(2,4-dimethylvaleronitrile), 2,2'-azobis(2-methylbutyronitrile), dimethyl-2,2'-azobis isobutyrate, 1,1'-azobis(1-cyclohexanecarbonitrile), 2-(carbamoylazo)-isobutyronitrile, 2,2'-azobis(2,4,4-trimethylpentane), 2-phenylazo-2',4'-dimethyl-4'-methoxyvaleronitrile, 2,2'-azobis(2-methylpropane), ketone peroxides (e.g., methyl ethyl ketone peroxide, acetylacetone peroxide, cyclohexanone peroxide), 2,2-bis(tert-butylperoxy)butane, tert-butyl hydroperoxide, cumene hydroperoxide, 1,1,3,3-tetramethylbutyl hydroperoxide, di-tert-butyl peroxide, tert-butylcumyl peroxide, di-cumyl peroxide, α-(tert-butylperoxy)isopropylbenzene, isobutyl peroxide, octanoyl peroxide, decanoyl peroxide, lauroyl peroxide, 3,5,5-trimethylhexanoyl peroxide, benzoyl peroxide, m-tolyl peroxide, di-isopropylperoxy dicarbonate, bis(2-ethylhexyl)peroxy dicarbonate, di-n-propylperoxy dicarbonate, bis(2-ethoxyethyl)peroxy carbonate, bis(ethoxyisopropyl)peroxy dicarbonate, bis(3-methyl-3-methoxybutyl)peroxy carbonate, acetylcyclohexylsulfonyl peroxide, tert-butylperoxy acetate, tert-butylperoxy isobutylate, tert-butylperoxy-2-ethylhexanoate, tert-butylperoxy laurate, tert-butyloxy benzoate, tert-butylperoxy isopropyl carbonate, di-tert-butylperoxy isophthalate, tert-butylperoxy allyl carbonate, isoamylperoxy-2-ethylhexanoate, di-tert-butylperoxy hexahydroterephthalate, and tert-butylperoxy azelate. These polymerization initiators can be used alone or in combination.

From the viewpoint of fixability, hot offset resistance, and storage stability of the resultant toner, suitable vinyl polymers preferably have a molecular weight distribution in which at least one peak is observed within a molecular weight range of from $3\times10^3$ to $5\times10^4$ and at least one peak is observed within a molecular weight range of $1\times10^5$ or more, when THF-soluble components thereof are subjected to GPC (gel permeation chromatography). More preferably, the THF-soluble components include components having a molecular weight of $1\times10^5$ or less in an amount of from 50 to 90% by weight, and a main peak is observed within a molecular weight range of from $5\times10^3$ to $3\times10^4$, much more preferably from $5\times10^3$ to $2\times10^4$, in the molecular weight distribution measured by GPC.

The molecular weight may be calculated from polystyrene standard samples. Usable solvents for GPC may be THF, for example.

Suitable vinyl polymers preferably have an acid value of from 0.1 to 100 mgKOH/g, more preferably from 0.1 to 70 mgKOH/g, and much more preferably from 0.1 to 50 mgKOH/g.

Suitable polyesters may be condensation products of an alcohol having 2 or more valences with a carboxylic acid having 2 or more valences. When an alcohol having 3 or more valences and/or a carboxylic acid having 3 or more valences are/is used, the resultant polyester may be cross-linked.

Specific examples of usable divalent alcohols include, but are not limited to, ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, and diols obtained from ring-opening addition of cyclic ethers such as ethylene oxide and propylene oxide to bisphenol A. These alcohols can be used alone or in combination.

Specific examples of usable alcohols having 3 or more valences include, but are not limited to, sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxybenzene. These alcohols can be used alone or in combination.

Specific examples of usable divalent carboxylic acids include, but are not limited to, benzene dicarboxylic acids such as phthalic acid, isophthalic acid, and terephthalic acid, and anhydrides thereof; alkyl dicarboxylic acids such as succinic acid, adipic acid, sebacic acid, and azelaic acid, and anhydrides thereof; and unsaturated dibasic acids such as maleic acid, citraconic acid, itaconic acid, alkenylsuccinic acid, fumaric acid, and mesaconic acid, and anhydrides thereof. These carboxylic acids can be used alone or in combination.

Specific examples of usable carboxylic acids having 3 or more valences include, but are not limited to, trimellitic acid, pyromellitic acid, 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxy-2-methyl-2-methylenecarboxypropane, tetra(methylenecarboxy)methane, 1,2,7,8-octanetetracarboxylic acid, and EMPOL trimer acid, and anhydrides and partial lower alkyl esters thereof. These carboxylic acids can be used alone or in combination.

From the viewpoint of fixability, hot offset resistance, and storage stability of the resultant toner, suitable polyesters preferably have a molecular weight distribution in which at least one peak is observed within a molecular weight range of from $3\times10^3$ to $5\times10^4$, when THF-soluble components thereof are subjected to GPC (gel permeation chromatography). More preferably, the THF-soluble components include components having a molecular weight of $1\times10^5$ or less in an amount of from 60 to 100% by weight, and a main peak is observed within a molecular weight range of from $5\times10^3$ to $2\times10^4$ in the molecular weight distribution measured by GPC.

Suitable polyesters preferably have an acid value of from 0.1 to 100 mgKOH/g, more preferably from 0.1 to 70 mgKOH/g, and much more preferably from 0.1 to 50 mgKOH/g.

When a vinyl polymer and/or a polyester and another resin are used in combination, the mixture resin preferably includes resins having an acid value of from 0.1 to 50 mgKOH/g in an amount of from 60 to 100% by weight.

The acid values may be measured according to JIS K0070.

The mother particles T preferably have a glass transition temperature of from 35 to 80° C., and more preferably from 40 to 75° C. When the glass transition temperature is too low, the resultant toner may deteriorate in high-temperature atmosphere and cause offset problem when being fixed. When the glass transition temperature is too high, low temperature fixability of the resultant toner may be poor.

Specific examples of usable colorants include, but are not limited to, dyes and pigments such as carbon black, Nigrosine dyes, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone, etc. These colorants can be used alone or in combination.

The toner components preferably include the colorant in an amount of from 1 to 15% by weight, and more preferably from 3 to 10% by weight.

When a pigment is used as the colorant, the toner components preferably include a pigment dispersing agent having a high compatibility with resins. Specific examples of usable commercially available pigment dispersing agents include, but are not limited to, AJISPER® PB-821 and PB-822 (from Ajinomoto-Fine-Techno Co., Inc.), DISPERBYK®-2001 (from BYK-Chemie Gmbh), and EFKA® 4010 (from EFKA Additives BV).

The toner components preferably include the pigment dispersing agent in an amount of from 0.1 to 10% by weight, based on total weight of the pigment. When the amount is too small, the pigment may not be sufficiently dispersed. When the amount is too large, chargeability of the resultant toner may deteriorate in high-humidity conditions.

Suitable pigment dispersing agents preferably have a molecular weight distribution in which a local maximum value of a main peak is observed within a molecular weight range of from 500 to $1\times10^5$, more preferably from $3\times10^3$ to $1\times10^5$, much more preferably from $5\times10^3$ to $5\times10^4$, and the most preferably from $5\times10^3$ to $3\times10^4$, when measured by GPC (gel permeation chromatography). When the local maximum value of a main peak is too small, the polarity of the pigment dispersing agent may be too large. Therefore, the pigment may not be sufficiently dispersed. When the local maximum value of a main peak is too large, the pigment dispersing agent may have so large a compatibility with solvents that the pigment may not be sufficiently dispersed.

These colorants can be combined with a resin to be used as a master batch. Specific examples of usable resins for the master batch include, but are not limited to, styrene homopolymers (e.g., polystyrenes, poly-p-chlorostyrenes, polyvinyltoluenes), styrene copolymers (e.g., styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloro methacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers, styrene-maleic acid ester copolymers), polymethylmethacrylates, polybutylmethacrylates, polyvinyl chlorides, polyvinyl acetates, polyethylenes, polypropylenes, polyesters, epoxy resins, epoxy polyol resins, polyurethanes, polyamides, polyvinyl butyrals, polyacrylic acids, rosins, modified rosins, terpene resins, aliphatic or alicyclic hydrocarbon resins, aromatic petroleum resins, chlorinated paraffins, and paraffin waxes. These resins can be used alone or in combination.

The resin used for the master batch preferably has an acid value of 30 mgKOH/g or less and an amine value of from 1 to 100 mgKOH/g, and more preferably an acid value of 20 mgKOH/g or less and an amine value of from 10 to 50 mgKOH/g. When the acid value is too large, chargeability of the toner may deteriorate under high humidity conditions and dispersibility of the colorant may deteriorate. When the amine value is too small or large, dispersibility of the colorant may deteriorate.

The amine value may be measured according to JIS K-7237.

The master batches can be prepared by mixing one or more of the resins as mentioned above and the colorant as mentioned above and kneading the mixture while applying a high shearing force thereto. In this case, an organic solvent can be added to increase the interaction between the colorant and the resin.

In addition, a flushing method in which an aqueous paste including a colorant and water is mixed with a resin dissolved in an organic solvent and kneaded so that the colorant is transferred to the resin side (i.e., the oil phase), and then the organic solvent (and water, if desired) is removed, can be preferably used because the resultant wet cake can be used as it is without being dried.

When performing the mixing and kneading process, dispersing devices capable of applying a high shearing force, such as three roll mills, can be preferably used.

The toner components preferably include the master batch in an amount of from 0.1 to 20% by weight based on total weight of the resin.

Specific examples of usable waxes include, but are not limited to, aliphatic hydrocarbon waxes (e.g., low-molecular-weight polyethylene, low-molecular-weight polypropylene, polyolefin wax, microcrystalline wax, paraffin wax, SASOL wax), oxides of aliphatic hydrocarbon waxes (e.g., polyethylene oxide wax) and copolymers thereof, plant waxes (e.g., candelilla wax, carnauba wax, haze wax, jojoba wax), animal waxes (e.g., bees wax, lanoline, spermaceti wax), mineral waxes (e.g., ozokerite, ceresin, petrolatum), waxes including fatty acid esters as main components (e.g., montanic acid ester wax, castor wax), partially or completely deacidified fatty acid esters (e.g., deacidified carnauba wax), saturated straight-chain fatty acids (e.g., palmitic acid, stearic acid, montanic acid), unsaturated fatty acids (e.g., brassidic acid, eleostearic acid, parinaric acid), saturated alcohols (e.g., stearyl alcohol, eicosyl alcohol, behenyl alcohol, carnaubyl alcohol, ceryl alcohol, melissyl alcohol), polyols (e.g., sorbitol), fatty acid amides (e.g., linoleic acid amide, olefin acid amide, lauric acid amide), saturated fatty acid bisamides (e.g., methylenebis capric acid amide, ethylenebis lauric acid amide, hexamethylenebis stearic acid amide), unsaturated fatty acid amides (e.g., ethylenebis oleic acid amide, hexamethylenebis oleic acid amide, N,N'-dioleyl adipic acid amide, N,N'-dioleyl sebacic acid amide), aromatic biamides (e.g., m-xylenebis stearic acid amide, N,N-distearyl isophthalic acid amide), metal salts of fatty acids (e.g., calcium stearate, calcium laurate, zinc stearate, magnesium stearate), aliphatic hydrocarbon waxes to which a vinyl, monomer such as styrene and an acrylic acid is grafted, partial ester compounds of a fatty acid (such as behenic acid monoglyceride) with a polyol, and methyl ester compounds having a hydroxyl group obtained by hydrogenating plant fats. These waxes can be used alone or in combination.

Among these waxes, the following compounds are preferable: a polyolefin obtained by radical polymerizing an olefin under high pressure; a polyolefin obtained by purifying low-molecular-weight by-products of a polymerization reaction of a high-molecular-weight polyolefin; a polyolefin polymerized under low pressure in the presence of a Ziegler catalyst or a metallocene catalyst; a polyolefin polymerized using radiation, electromagnetic wave, or light; a low-molecular-weight polyolefin obtained by thermally decomposing a high-molecular-weight polyolefin; paraffin wax; microcrystalline wax; Fischer-Tropsch wax; synthesized hydrocarbon waxes synthesized by Synthol method, Hydrocaol method, or Arge method; synthesized waxes including a compound having one carbon atom as a monomer unit; hydrocarbon waxes having a functional group such as hydroxyl group and carboxyl group; mixtures of a hydrocarbon wax and a hydrocarbon wax having a functional group; and these waxes to which a vinyl monomer such as styrene, a maleate, an acrylate, a methacrylate, or a maleic anhydride is grafted.

These waxes may be preferably subjected to a press sweating method, a solvent method, a recrystallization method, a vacuum distillation method, a supercritical gas extraction method, or a solution crystallization method, so as to more narrow the molecular weight distribution thereof. Further, it is preferable that impurities such as low-molecular-weight solid fatty acids, low-molecular-weight solid alcohols, and low-molecular-weight solid compounds are removed from these waxes.

The wax preferably has a melting point of from 70 to 140° C., and more preferably from 70 to 120° C. When the melting point is too small, toner blocking resistance may deteriorate. When the melting point is too large, offset resistance may deteriorate.

The melting point of a wax is defined as a temperature at which the maximum endothermic peak is observed in an endothermic curve measured by DSC. Endothermic curves can be measured using a high-precision inner-heat power-compensation differential scanning calorimeter. The measurement is performed according to ASTM D3418-82. The endothermic curve is obtained by heating a sample at a temperature increasing rate of 10° C./min, after once heating and cooling the sample.

When two waxes are used in combination and the difference in melting point between the two waxes is from 10 to 100° C., the wax mixture may simultaneously express plasticizing ability and releasing ability. In this case, the wax which expresses plasticizing ability has a lower melting point compared to the other. Such a wax may have a branched-chain structure or a polar group, for example. On the other hand, the wax which expresses releasing ability has a higher melting point compared to the other. Such a wax may have a straight-chain structure or no polar group, for example. It is preferable that one of the waxes has a melting point of from 70 to 120° C., and more preferably from 70 to 100° C.

Specific preferred examples of such wax combinations include, but are not limited to, the followings: a combination of a homopolymer or copolymer of a polyethylene which consists primarily of ethylene and a homopolymer or copolymer of a polyolefin which consists primarily of an olefin other than ethylene; a combination of a polyolefin and a graft-modified polyolefin; a combination of an alcohol wax, a fatty acid wax, or an ester wax, and a hydrocarbon wax; a combination of a Fisher-Tropsch wax or a polyolefin wax, and a paraffin wax or a microcrystalline wax; a combination of a Fisher-Tropsch wax and a polyolefin wax; a combination of a paraffin wax and a microcrystalline wax; and a combination of a carnauba wax, a candelilla wax, a rice wax, or a montan wax, and a hydrocarbon wax.

The toner components preferably include a wax in an amount of from 0.2 to 20% by weight, more preferably from 0.5 to 10% by weight, based on total weight of the resin.

Specific examples of usable magnetic materials include, but are not limited to, magnetic iron oxides such as magnetite, maghemite, and ferrite, and iron oxides including other metal oxides; and metals such as iron, cobalt, and nickel, and alloys of these metals with aluminum, cobalt, copper, lead, magnesium, tin, zinc, antimony, beryllium, bismuth, cadmium, calcium, manganese, selenium, titanium, tungsten, vanadium, etc. These materials can be used alone or in combination.

More specifically, specific preferred examples of usable magnetic materials include, but are not limited to, $Fe_3O_4$, $\gamma$-$Fe_2O_3$, $ZnFe_2O_4$, $Y_3Fe_5O_{12}$, $CdFe_2O_4$, $Gd_3Fe_5O_{12}$, $CuFe_2O_4$ $PbFe_{12}O$, $NiFe_2O_4$, $NdFe_2O$, $BaFe_{12}O_{19}$, $MgFe_2O_4$, $MnFe_2O_4$, $LaFeO_3$, iron powder, cobalt powder, and nickel powder. Among these materials, $Fe_3O_4$ and $\gamma$-$Fe_2O_3$ are preferable.

In addition, magnetic iron oxides (such as magnetite, maghemite, and ferrite) which include heterogeneous elements are also preferable. The heterogeneous elements may be lithium, beryllium, boron, magnesium, aluminum, silicon, phosphor, germanium, zirconium, tin, sulfur, calcium, scandium, titanium, vanadium, chrome, manganese, cobalt, nickel, copper, zinc, and gallium, for example. Among these elements, magnesium, aluminum, silicon, phosphor, and zirconium are preferable. Heterogeneous elements may be incorporated in crystal lattice of iron oxides. Alternatively, oxides of heterogeneous elements may be incorporated in iron oxides. Further, oxides or hydroxides of heterogeneous elements may be present on the surface of iron oxides. It is most preferable that oxides of heterogeneous elements are incorporated in iron oxides.

In order to incorporate a heterogeneous element in a magnetic material, a magnetic material may be produced in the presence of a salt of a heterogeneous element while controlling pH. In order to deposit a heterogeneous element on a surface of a magnetic material, a salt of a heterogeneous element is mixed with a magnetic material while controlling pH.

The magnetic material preferably has a number average particle diameter of from 0.1 to 2 μm, and more preferably from 0.1 to 0.5 μm. The number average particle diameter can be determined by magnifying and photographing a magnetic material with a transmission electron microscope and measuring the photograph using a digitizer.

The magnetic material preferably has a coercivity of from 20 to 150 oersted, a saturated magnetization of from 50 to 200 emu/g, and a remanent magnetization of from 2 to 20 emu/g.

The toner components preferably include a magnetic material in an amount of from 10 to 200 parts by weight, more preferably from 20 to 150 parts by weight, based on 100 parts by weight of the binder resin.

The magnetic material can be also used as a colorant.

The mother particles T may be used as a toner without any treatment, or by mixing with external additives such as a fluidity improving agent and a cleanability improving agent.

Specific examples of usable fluidity improving agents include, but are not limited to, carbon blacks; fine powders of fluorocarbon resins such as vinylidene fluoride and polytetrafluoroethylene; silica prepared by a wet process or a dry process, titanium oxide, and alumina; and these silica, titanium oxide, and alumina which are surface-treated with a silane-coupling agent, a titanium-coupling agent, or a silicone oil. Among these materials, silica, titanium oxide, and alumina are preferable, and silica which is surface-treated with a silane compound is more preferable.

Specific examples of usable commercially available silica prepared by vapor phase oxidization of halogenated silicon compounds include, but are not limited to, AEROSIL® 130, 300, 380, TT600, MOX170, MOX80, and COK84 (from Nippon Aerosil Co., Ltd.), CAB-O-SIL® M-5, MS-7, MS-75, HS-5, and EH-5 (from Cabot Corporation), WACKER HDK® N20, V15, N20E, T30, and T40 (from Wacker Chemie Gmbh), Dow Corning® Fine Silica (from Dow Corning Corporation), and FRANSIL (from Fransol Co.).

The fluidity improving agent preferably has a number average particle diameter of from 5 to 100 nm, and more preferably from 5 to 50 nm.

The fluidity improving agent preferably has a specific surface area of 30 $m^2/g$ or more, and more preferably from 60 to 400 $m^2/g$, measured by BET method. The surface-treated fluidity improving agent preferably has a specific surface area of 20 $m^2/g$ or more, and more preferably from 40 to 300 $m^2/g$, measured by BET method.

In a silica which is hydrophobized using a silane compound, the silane compound is chemically or physically adsorbed to silica. Such a hydrophobized silica preferably has a hydrophobized degree of from 30 to 80%, measured by a methanol titration test.

Specific examples of the organic silicon compounds include, but are not limited to, hydroxypropyltrimethoxysilane, phenyltrimethoxysilane, n-hexadecyltrimethoxysilane, n-octadecyltrimethoxysilane, vinyltrimethoxysilane, vinyltriethoxysilane, vinyltriacetoxysilane, dimethylvinylchlorosilane, divinylchlorosilane, γ-methacryloxypropyltrimethoxysilane, hexamethyldisilazane, trimethylsilane, trimethylchlorosilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilyl mercaptan, trimethylsilyl mercaptan, triorganosilyl acrylate, vinyldimethylacetoxysilane, dimethylethoxysilane, trimethylethoxysilane, trimethylmethoxysilane, methyltriethoxysilane, isobutyltrimethoxysilane, dimethyldimethoxysilane, diphenyldiethoxysilane, hexamethyldisiloxane, 1,3-divinyltetramethyldisiloxane, and 1,3-diphenyltetramethyldisiloxane. These compounds can be used alone or in combination. Among these compounds, dimethylpolysiloxane having 2 to 12 siloxane units and 0 to 1 terminal silanol group is preferable. Other than the above compounds, silicone oils such as dimethyl silicone oil are also preferable.

The mother particles T preferably include the fluidity improving agent in an amount of from 0.03 to 8% by weight based on total weight of the mother particles T.

Specific examples of usable cleanability improving agents include, but are not limited to, metal salts of fatty acids such as zinc stearate and calcium stearate; and particulate polymers such as polymethyl methacrylate and polystyrene, which are manufactured by a method such as soap-free emulsion polymerization methods. Particulate resins having a relatively narrow particle diameter distribution and a volume average particle diameter of from 0.01 μm to 1 μm are preferable for the cleanability improving agent.

Suitable mixers for mixing the mother particles T with the external additives include V-form mixers, locking mixers, Loedge Mixers, NAUTER MIXERS, HENSCHEL MIXERS, and the like mixers. Preferably, these powder mixers are equipped with a jacket for controlling the inner temperature. External additives may be added in the middle of the mixing process, or gradually added over the mixing process. The rotation number, rolling speed, mixing time, and temperature of the powder mixer may be variable. In the mixing process, a relatively high stress may be applied first and subsequently a relatively low stress may be applied, or vice versa.

The mother particles T may be further mixed with other additives. For example, metal soaps, fluorine-based surfactants, and dioctyl phthalate may be mixed with the mother particles T for the purpose of protecting electrostatic latent image bearing members and carriers, improving cleanability and fixability, controlling thermal properties, electric properties, physical properties, resistance, and melting point. In addition, conductivity imparting agents such as tin oxide, zinc oxide, carbon black, and antimony oxide, and fine powders of inorganic materials such as titanium oxide, aluminum oxide, and alumina may be also mixed with the mother particles T, if needed. These fine powders of inorganic materials may be optionally hydrophobized. Moreover, lubricants such as polytetrafluoroethylene, zinc stearate, and polyvinylidene fluoride; abrasives such as cesium oxide, silicon carbide, and strontium titanate; anti-caking agents; and developability improving agents such as white or black particles having the opposite polarity to the mother particles T may be also mixed with the mother particles T.

For the purpose of controlling the charge amount, the above-described additives maybe treated with a silicone varnish, a modified silicone varnish, a silicone oil, a modified silicone oil, a silane-coupling agent, a silane-coupling agent having a functional group, an organic silicon compound, etc.

The toner may be used as either a one-component developer or a two-component developer by mixing with a carrier. The carrier may consist essentially of a core particle, the surface of which is coated with a resin.

Specific examples of usable core particles include, but are not limited to, magnetic materials such as oxides (e.g., ferrite, iron excess ferrite, magnetite, γ-iron oxide); and metals (e.g., iron, cobalt, nickel) and alloys thereof. These magnetic materials may include elements such as iron, cobalt, nickel, aluminum, copper, lead, magnesium, tin, zinc, antimony, beryllium, bismuth, calcium, manganese, selenium, titanium, tungsten, and vanadium. In particular, copper-zinc-iron ferrite which consists primarily of copper, zinc, and iron, and manganese-magnesium-iron ferrite which consists primarily of manganese, magnesium, and iron are preferable. In addition, resin particles in which magnetic materials are dispersed are also usable for the core particle.

Specific examples of usable coating resins include, but are not limited to, styrene-acrylic resins such as styrene-acrylate copolymers and styrene-methacrylate copolymers; acrylic resins such as acrylate copolymers and methacrylate copolymers; fluorine-containing resins such as polytetrafluoroethylene, polychlorotrifluoroethylene, and polyvinylidene fluoride; and other resins such as silicone resins, polyesters, polyamides, polyvinyl butyral, amino acrylate resins, ionomer resins, and polyphenylene sulfides. These resins can be used alone or in combination. Among these resins, styrene-methyl methacrylate copolymers, mixtures of a fluorine-containing resin with a styrene copolymer, and silicone resins are preferable, and silicone resins are most preferable.

Specific examples of usable mixtures of a fluorine-containing resin with a styrene copolymer include, but are not limited to, a mixture of a polyvinylidene fluoride with a styrene-methyl methacrylate copolymer; a mixture of a polytetrafluoroethylene with a styrene-methyl methacrylate copolymer; and a mixture of a vinylidene fluoride-tetrafluoroethylene copolymer (copolymerization weight ratio is 10:90 to 90:10), a styrene-2-ethylhexyl acrylate copolymer (copolymerization weight ratio is 10:90 to 90:10), and a styrene-2-ethylhexyl acrylate-methyl methacrylate copolymer (copolymerization weight ratio is (20 to 60):(5 to 30):(10 to 50)).

Specific examples of usable silicone resins include, but are not limited to, nitrogen-containing silicone resins and modified silicone resins which are prepared by a reaction between a nitrogen-containing silane coupling agent and a silicone resin.

The carrier preferably includes the coating resin in an amount of from 0.01 to 5% by weight, more preferably from 0.1 to 1% by weight, based on total weight of the carrier.

An exemplary method of coating core particles with coating resins includes, for example, applying a solution or dispersion of a resin to a core particle. Another exemplary method includes simply mixing a resin and a core particle.

The carrier preferably has a resistivity of from $10^6$ to $10^{10}$ Ω·cm.

The carrier preferably has a particle diameter of from 4 to 200 μm, more preferably from 10 to 150 μm, and much more preferably from 20 to 100 μm. In particular, resin-coated carriers preferably have a 50% cumulative particle diameter of from 20 to 70 μm.

Two-component developers preferably include the toner in an amount of from 1 to 200 parts by weight, more preferably from 2 to 50 parts by weight, based on 100 parts by weight of the carrier.

The above-described one-component developers and two-component developers may be used for electrophotography, electrostatic recording, or electrostatic printing. The developers develop electrostatic latent images formed on electrostatic latent image bearing members such as organic electrostatic latent image bearing members, amorphous silica electrostatic latent image bearing members, selenium electrostatic latent image bearing members, and zinc oxide electrostatic latent image bearing members.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Preparation of Toner Components Liquid

First, 17 parts of a carbon black REGAL® 400 (from Cabot Corporation), 3 parts of a pigment dispersing agent AJISPER® PB821 (from Ajinomoto Fine-Techno Co., Inc.), and 80 parts of ethyl acetate were subjected to a primary dispersion treatment using a mixer equipped with agitation blades. The resultant primary dispersion was subjected to a secondary dispersion treatment using a DYNO MILL. Aggregations having a particle diameter of 5 μm or more were removed from the secondary dispersion. Thus, a pigment dispersion was prepared.

Next, 18 parts of a carnauba wax, 2 parts of a wax dispersing agent (i.e., a polyethylene wax to which a styrene-butyl acrylate copolymer is grafted), and 80 parts of ethyl acetate were subjected to a primary dispersion treatment using a mixer equipped with agitation blades. The resultant primary dispersion was heated to 80° C. while being agitated so that the carnauba wax was melted, and subsequently cooled to room temperature so that particles of the carnauba wax having a particle diameter of 3 μm or less were deposited. The primary dispersion was then subjected to a secondary dispersion treatment using a DYNO MILL so that the particles of the carnauba wax had a particle diameter of 2 μm or less. Thus, a wax dispersion was prepared.

Next, 100 parts of a polyester, 30 parts of the pigment dispersion, 30 parts of the wax dispersion, and 840 parts of ethyl acetate were mixed for 10 minutes using a mixer equipped with agitation blades. Thus, a toner components liquid was prepared. The toner components liquid has an electric conductivity of $1.8\times10^{-7}$ S/m.

Example 1

(Preparation of Mother Particles)

The toner components liquid was contained in the tank 151 and supplied to the liquid droplet discharge unit 110 using the pump 152 in the toner production apparatus 100 illustrated in FIG. 1. The thin film 111*a* was made from an SOI substrate having a thickness of 500 μm, by the method illustrated in FIGS. 3A to 3D. The openings 211*a* and 213*a* were formed into hound's-tooth pattern in which the distance between adjacent openings 213*a* was 100 μm. The openings 211*a* and 213*a* each had a diameter of 100 μm and 8.5 μm, respectively. The thin film 111*a* had a resonance frequency of 74 kHZ when measured using PSV300 (from Polytech). The thin film 111*a* was bonded to the retention member 111 so that the openings 211*a* face the retention regions 111*c* and the openings 213*a* discharge the toner components liquid. The number of the retention regions 111*c* formed by the partitions 111*b* within the retention member 111 was 6. Each of the retention regions 111*c* had 480 discharge openings on a surface with each side having a length of 8 mm. Nitrogen gas was flowed in the airflow path 116 so that the average linear speed at the vicinity of the discharge openings was 20 m/sec. The vibration application member 112 applied a vibration having a frequency of 32.7 kHz to the toner components liquid so that the toner components liquid was resonated and liquid droplets L were discharged. The liquid droplets L were dried into mother particles T in the drying tower 120. The mother particles T were collected in the collection part 130 and stored in the storage part 140. The voltage waveform applied from the driving circuit 115 to the ultrasonic vibrator 112*a* was sine wave. The toner production apparatus 100 was brought into operation for 1 hour and 9.8 g of mother particles T were obtained. The mother particles T stored in the storage part 140 were subjected to a measurement of particle size distribution using a particle size analyzer FPIA-2000 (from Sysmex Corporation). As a result, the mother particles T had a weight average particle diameter of 5.3 μm and a number average particle diameter of 5.1 μm.

(Measurement of Particle Diameter Distribution)

The measurement of particle size distribution was performed as follows. First, fine impurities were removed from water using a filter so that the water contained impurities having a circle-equivalent diameter of 0.60 μm or more and less than 159.21 μm in an amount of 20 particles or less per $10^{-3}$ $cm^3$. The circle-equivalent diameter is the diameter of a circle with the same area as a particle. A few drops of a nonionic surfactant CONTAMINON® N (from Wako Pure Chemical Industries, Ltd.) and 5 mg of the mother particles T were dropped in 10 ml of the above-prepared water. The resultant suspension was subjected to a dispersion treatment for 5 minutes at 20 kHz and 50 W/10 $cm^3$ using an ultrasonic disperser UH-50 (from SMT Co., Ltd.). The resulting dispersion contained particles having a circle-equivalent diameter of 0.60 μm or more and less than 159.21 μm in an amount of from 4,000 to 8,000 particles per $10^{-3}$ $cm^3$. The dispersion was subjected to a measurement of particle size distribution as follows.

The dispersion was passed through a flow path of a flat and transparent flow cell (having a thickness of about 200 μm). The flow path widens along the direction of flow. A strobe light and a CCD camera were provided on opposite sides of the flow cell relative to the direction of thickness so that an optical path was formed across the flow cell relative to the direction of thickness. The strobe light flashed at every 1/30 seconds so as to capture images of particles in the dispersion while the dispersion was passed through the flow cell. The captured images were dimensional images substantially parallel to the flow cell. The circle-equivalent diameter, which is the diameter of a circle with the same area as a particle, was calculated from the dimensional images. During 1-minute measurement, 1,200 or more mother particles were subjected to the determination of the circle-equivalent diameter.

(Preparation of Toner)

The mother particles T were mixed with 1.0% by weight of a hydrophobized silica H200 (from Clarian Japan K.K.) using a HENSCHEL MIXER (from Mitsui Mining Co., Ltd.). Thus, a toner 1 was prepared.

Example 2

The procedure for preparing toner in Example 1 is repeated except that the retention member 111 is replaced with another one in which 6,400 discharge openings are formed in a reticular pattern in each of the retention regions 111*c*. The thin film 111*a* has a resonance frequency of 74 kHZ when measured using PSV300 (from Polytech). The toner production apparatus 100 is brought into operation for 1 hour and 320 g of mother particles T are obtained. The mother particles T stored in the storage part 140 are subjected to a measurement of particle size distribution using a particle size analyzer FPIA-2000 (from Sysmex Corporation). As a result, the mother particles T have a weight average particle diameter of 5.4 μm and a number average particle diameter of 5.2 μm.

Example 3

The procedure for preparing toner in Example 1 is repeated except that the retention member 111 is replaced with another one in which 7,390 discharge openings are formed in each of the retention regions 111*c*. The thin film 111*a* has a resonance frequency of 74 kHZ when measured using PSV300 (from Polytech). The toner production apparatus 100 is brought into operation for 1 hour and 382 g of mother particles T are obtained. The mother particles T stored in the storage part 140 are subjected to a measurement of particle size distribution using a particle size analyzer FPIA-2000 (from Sysmex Corporation). As a result, the mother particles T have a weight average particle diameter of 5.4 μm and a number average particle diameter of 5.2 μm.

Comparative Example 1

The procedure for preparing toner in Example 3 was repeated except that the thin film 111*a* was replaced with a thin film made of nickel on which openings having a diameter of 10 μm and a thickness of 50 μm were formed by electroforming, and the frequency of the vibration applied from the vibration application member 112 to the toner components liquid was changed to 60 kHZ. The toner production apparatus 100 was brought into operation for 1 hour and 227 g of mother particles T were obtained. The mother particles T stored in the storage part 140 were subjected to a measurement of particle size distribution using a particle size analyzer FPIA-2000 (from Sysmex Corporation). As a result, the mother particles T had a weight average particle diameter of 5.6 μm and a number average particle diameter of 5.0 μm.

Since the resonance frequency of the thin film made of nickel was smaller than the frequency of the vibration applied from the vibration application member 112 to the toner components liquid, the thin film made of nickel had several vibration modes. As a result, liquid droplets were discharged unevenly and the liquid droplets had a wide variation in size. The resultant mother particles T also had a wide size distribution.

Preparation of Developers

A dispersion in which a silicone resin was dispersed in toluene was spray-coated on spherical ferrite particles having an average particle diameter of 50 μm while being heated. The ferrite particles were then calcined and cooled so that a coating layer having a thickness of 0.2 μm was formed thereon. Thus, a carrier was prepared.

Each of the toners prepared above is mixed with the carrier to prepare two-component developers.

Evaluation of Thin-Line Reproducibility

Each of the developers was/is set in a copier IMAGO NEO 271 (from Ricoh Co., Ltd.) in which the developing device is modified. An image chart in which 7% by area is occupied with toner image is continuously produced on a paper TYPE 6000 (from Ricoh Co., Ltd.). The 10th and 30,000th produced images are visually observed with an optical microscope at a magnification of 100 times to evaluate reproducibility of thin lines. Thin lines are compared to image samples and graded into 4 levels A, B, C, and D. A is the best and D is the worst. The level D is not suitable for practical use.

The evaluation results are as follows.

Examples 1-3: A

Comparative Example 1: D

It is apparent from the evaluation results that Example toners have high productivity. Example toners also have high thin-line reproducibility because of having a narrow size distribution.

Additional modifications and variations of the present invention are possible in light of the above teachings. It is therefore to be understood that within the scope of the appended claims the invention may be practiced other than as specifically described herein.

This document claims priority and contains subject matter related to Japanese Patent Application No. 2008-274642, filed on Oct. 24, 2008, the entire contents of which are herein incorporated by reference.

What is claimed is:

1. A method for producing toner, comprising: supplying a fluid comprising a resin and a colorant to a retention member that includes a film made of silicon or a complex of silicon and silicon oxide, on which multiple discharge openings are formed; discharging liquid droplets of the fluid which is supplied to the retention member from the multiple discharge openings by resonating the fluid; and solidifying the liquid droplets which are discharged from the multiple discharge openings to form mother particles of a toner; wherein the fluid is resonated by applying a vibration, having a frequency less than a resonance frequency of the film, to the fluid which is supplied to the retention member.

2. The method for producing toner according to claim 1, wherein the discharge openings each have an aperture diameter of from 4 to 15 μm.

3. The method for producing toner according to claim 1, wherein the frequency less than the resonance frequency of the film is 20 kHz or more and less than 200 kHz.

4. The method for producing toner according to claim 1, wherein the retention member comprises multiple retention regions formed by multiple partitions.

5. The method for producing toner according to claim 4, wherein the number of the discharge openings included in each of the retention regions is from 100 to 10,000.

6. The method for producing toner according to claim 1, wherein the fluid further comprises a solvent, and the method further comprises:

removing the solvent to dry the liquid droplets into the mother particles.

7. The method for producing toner according to claim 1, further comprising:

transporting the liquid droplets which are discharged from the multiple discharge openings by a gas that flows in a direction substantially the same as a direction of discharge of the liquid droplets.

8. The method for producing toner according to claim 7, wherein the gas is air or nitrogen.

9. The method for producing toner according to claim 1, wherein a ratio of a weight average particle diameter to a number average particle diameter of the mother particles is from 1.00 to 1.15.

10. The method for producing toner according to claim 1, wherein the mother particles have a weight average particle diameter of from 1 to 20 μm.

* * * * *